United States Patent [19]

Sasaki

[11] Patent Number: 4,803,522

[45] Date of Patent: Feb. 7, 1989

[54] SHEET REFEEDING APPARATUS

[75] Inventor: Hiromu Sasaki, Yamatokoriyama, Japan

[73] Assignee: Sharp Kabushiki Kaisha, Osaka, Japan

[21] Appl. No.: 62,838

[22] Filed: Jun. 16, 1987

[30] Foreign Application Priority Data

Jun. 16, 1986 [JP] Japan ..... 61-140499

[51] Int. Cl.[4] ..... G03B 27/32; G03B 27/52

[52] U.S. Cl. ..... 355/26; 355/23; 355/50

[58] Field of Search ..... 355/23, 24, 25, 26, 355/50

[56] References Cited

U.S. PATENT DOCUMENTS

| | | | |
|---|---|---|---|
| 4,158,500 | 6/1979 | DiFrancesco et al. | 355/23 |
| 4,365,886 | 12/1982 | Murakami et al. | 355/23 |
| 4,453,819 | 6/1984 | Wada et al. | 355/23 |
| 4,512,651 | 4/1985 | Dunleavy | 355/23 |

*Primary Examiner*—Monroe H. Hayes

*Attorney, Agent, or Firm*—Birch, Stewart, Kolasch & Birch

[57] ABSTRACT

A sheet refeeding apparatus for use in combination with a multipurpose image forming system capable of multistage copying operation. The sheet refeeding apparatus has a secondary sheet conveying mechanism forming a secondary sheet conveying path extending from the sheet discharge section to the sheet feed section of the image forming system, and includes variable speed driving means for regulating the operating speed of the secondary sheet conveying mechanism, memory means storing a plurality of control data for controlling the variable speed driving means, and selecting means for selecting control data for controlling the variable speed driving means so that the secondary sheet conveying means operates synchronously with the sheet conveying mechanism of the image forming system among those stored in the memory means.

9 Claims, 6 Drawing Sheets

SHEET REFEEDING APPARATUS

BACKGROUND OF THE INVENTION

The present invention relates to a sheet refeeding apparatus for use in combination with an image forming system such as a copying machine, for feeding a sheet repeatedly to the image forming unit of the image forming system for a multistage copying process such as a composite copying process in which a plurality of images are formed on one side of the sheet or a two-side copying process in which images are formed on both sides of the sheet.

There has been proposed a multipurpose copying machine capable of multistage copying processes including a composite copying process and a two-side copying process in addition to an ordinary single-side copying process. In a multistage copying process on such a conventional multipurpose copying machine, a sheet which has been subjected to an automatic copying process is guided to a secondary sheet conveying path extending from the sheet discharge section to the sheet feed section in addition to a main sheet conveying path extending from the sheet feed section to the sheet discharge section, and then the same sheet is fed again to the copying unit for another automatic copying process. There has been proposed a sheet refeeding apparatus for use in combination with such a multipurpose copying machine. This conventional sheet refeeding apparatus has an internal secondary sheet conveying mechanism for refeeding a sheet to such a multipurpose copying machine and is adapted for connection to the multipurpose copying machine as an additional unit. Generally, such a sheet refeeding apparatus further includes a sorter, a cabinet and related mechanisms and is provided with individual driving means for driving the secondary sheet conveying mechanism to convey a sheet through the secondary sheet conveying path thereof. The secondary sheet mechanism needs to operate synchronously with the main sheet conveying mechanism of the associated copying machine at the same operating speed as that of the main sheet conveying mechanism for a smooth and efficient conveyance of the sheet.

However, the conventional sheet refeeding apparatus is intended for use in combination with a particular copying machine and is unable to be used in combination with copying machines of different types. Accordingly, when the design and/or operating conditions of the copying machine are changed to update the copying machine, the sheet refeeding apparatus is unable to be combined with the newly developed copying machine. Therefore, the sheet, refeeding apparatus needs to be changed for another sheet refeeding apparatus machine is replaced with a newly developed copying machine, which imposes an additional expenditure on the user. Thus, the conventional sheet refeeding apparatus is designed for use in combination with a specific type of copying machine and hence is unable to be combined with general copying machines. Accordingly, the conventional sheet refeeding apparatus is economically disadvantageous, and is costly because the sheet refeeding apparatus is designed and manufactured specially for a specific copying machine.

SUMMARY OF THE INVENTION

Accordingly, it is an object of the present invention to provide a sheet refeeding apparatus including a secondary sheet conveying mechanism forming a secondary sheet conveying path, and capable of varying the operating speed and sheet refeed timing thereof so as to operate in synchronism with the main sheet conveying mechanism of an associated image forming system such as, for example, a copying machine, at an appropriate operating speed.

It is another object of the present invention to provide a sheet refeeding apparatus including a secondary sheet conveying mechanism forming a secondary sheet conveying path, capable of varying in operating speed and timing so as to be able to operate in synchronism with an associated copying machine regardless of the variation of the operating speed and timing of the copying machine, and capable of being combined with a plurality of types of copying machines without changing the design thereof.

Other objects and further scope of applicability of the present invention will become apparent from the detailed description given hereinafter. It should be understood however, that the detailed description of and specific examples, while indicating preferred embodiments of the invention, are given by way of illustration only, since various changes and modifications within the spirit and scope of the invention will become apparent to those skilled in the art from this detailed description.

To achieve the objects invention, the present invention provides a sheet refeeding apparatus, for use in combination with an image forming system having sheet conveying means forming a sheet conveying path extending from the sheet feed unit to the sheet discharge unit thereof, having secondary sheet conveying means forming a secondary sheet conveying path formed so as to extend from the sheet discharge unit to the sheet feed unit of the image forming system, which comprises: variable speed driving means for driving the secondary sheet feeding means at variable speeds; memory means storing control data for controlling the variable speed driving means; and selecting means for selecting control data appropriate for controlling the variable speed driving means so that secondary sheet conveying means is driven in synchronism with the sheet conveying means of the associated image forming system among those stored in the memory means.

The selecting means selects control data appropriate for controlling the variable speed driving means so that the secondary sheet conveying means is driven in synchronism with the conveying means of the associated image forming system among the data stored in the memory means, and the variable speed driving means is controlled according to the selected control data to properly regulate the operating speed of the secondary sheet conveying means.

Thus, according to the present invention, the selecting means selects control data appropriate for properly controlling the secondary sheet conveying means when the image forming system combined with the sheet refeeding apparatus is replaced with another one to change the operating speed of the secondary sheet conveying means. Accordingly, the sheet refeeding apparatus is able to operate in conformity with the operating conditions of the associated image forming system, and is capable of being combined generally with a plurality of types of image forming systems. Therefore, the sheet refeeding apparatus need not be replaced with another one even when the associated image forming system is modified, which reduces the user's expenditure. Furthermore, since the sheet refeeding apparatus need not be designed particularly for use in combination with a specific image forming system, the manufacturing cost thereof is reduced.

In brief, the sheet refeeding apparatus according to the present invention essentially comprises variable speed driving means for driving the secondary sheet conveying means at variable operating speeds, and memory means storing control data for controlling the variable speed driving means, appropriate control data is selected for properly driving the secondary sheet conveying means so that the secondary sheet conveying means operates in synchronism with the sheet conveying means of the associated image forming apparatus.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 2:
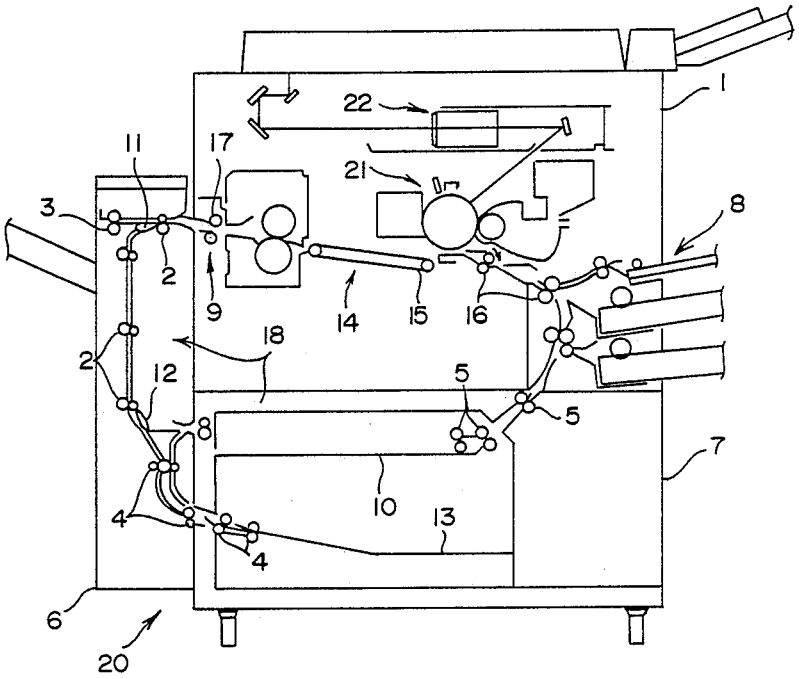
FIG. 2 is a schematic sectional view of the copying machine equipped with a sheet refeeding apparatus according to the present invention.

Referring to FIG. 2, a conveyor belt 15 and conveyor rollers 16 are arranged within a main copying unit to form a sheet conveying path 14 between a sheet feed section 8 and a sheet discharge section 9. A sorting unit 6 is joined to a side wall of the main copying unit 1 on the side of the sheet discharge section 9. The main copying unit 1 is mounted on a cabinet 7. The sorting unit 6 is provided internally with secondary conveyor rollers 2. Reversible switchback rollers 4 are supported for rotation in opposite directions within the sorting unit 6 and the cabinet 7 to form a switchback sheet conveying path 13. An intermediate tray 10 provided with secondary feed rollers 5 is disposed within the cabinet 7.

The secondary conveyor rollers 2 and the intermediate tray 10 provided with the secondary feed rollers 2 form a secondary sheet conveying path 18 between the sheet discharge section 9 and the sheet feed section 8. The switchback sheet conveying path 13 is connected to the secondary sheet conveying path 18. A sheet is guided selectively into the switchback sheet conveying path 13 by a guide 12 provided in the secondary sheet conveying path 18. A discharge roller 3 is provided in the sorting unit 6. A sheet delivered through the discharge section 9 is guided selectively to the discharge roller 3 or to the secondary sheet conveying path 18.

Figure 3:
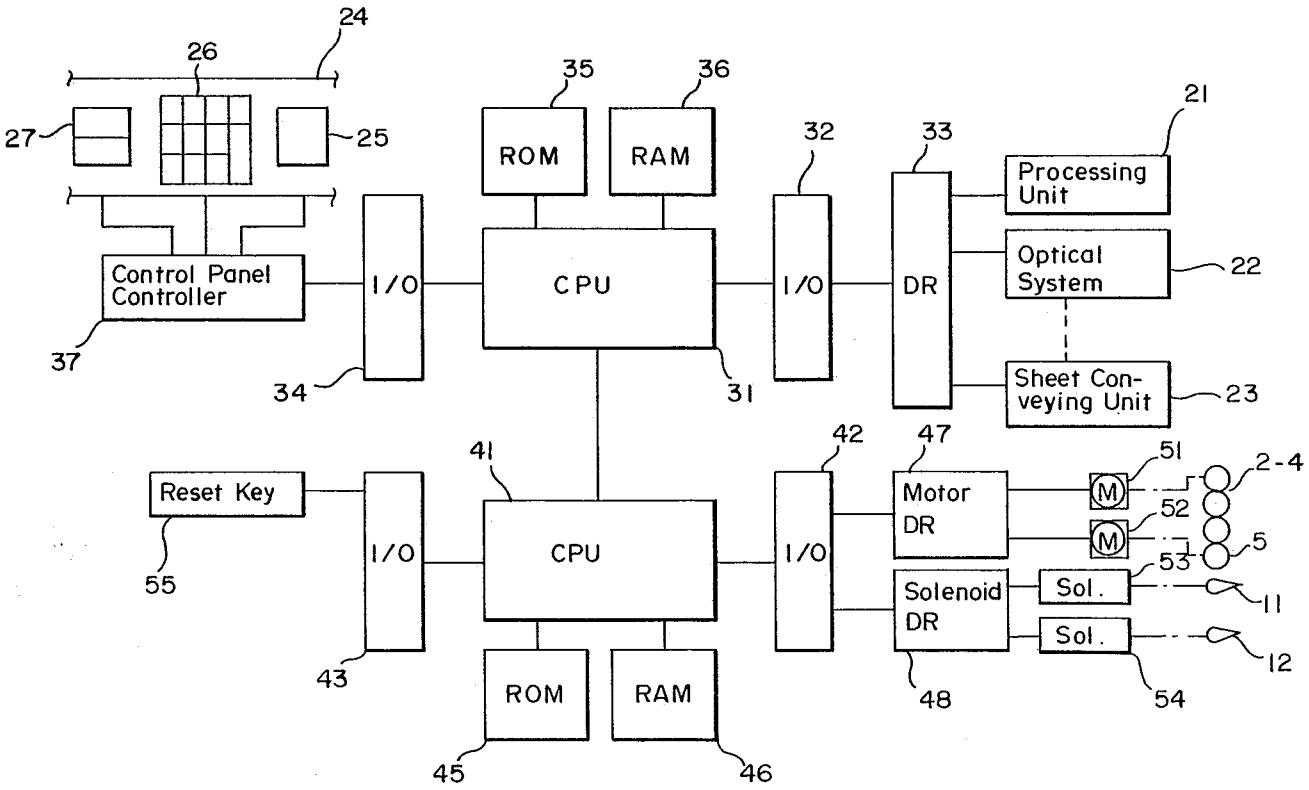
FIG. 3 is a block diagram of the respective control units of the copying machine and the sheet refeeding apparatus of FIG. 2.

Referring to FIG. 3 showing the respective control units of the copying machine and the sheet refeeding unit combined with the copying machine, the control unit of the main copying unit 1 has a CPU (central processing unit ) 31. Copying data and mode data are given from a control panel controller 37 through an I/O interface 34 to the CPU 31. A control panel 24 is provided with a print switch 25, numeric keys 26 and mode selecting keys 27. Data defining the operating conditions of the main copying unit 1 are given by means of the keys of the control panel 24. The CPU 31 gives control data for controlling a copying section 21, an optical system 22 and a sheet conveying unit 23 through an I/O interface 32 to a driver array 33 according to a program stored in a ROM (read-only memory) 35 on the basis of input data given thereto by means of the keys of the control panel 24. A RAM (random access memory) 36 connected to the CPU 31 serves as a working area in setting the output control data.

The control unit of the sheet refeeding unit has a CPU 41, which is connected to the CPU 31 of the main copying unit 1. Commands and data are given from the CPU 31 to the CPU 41, while messages are given from the CPU 41 to the CPU 31. The CPU 41 gives control data according to commands and data given thereto from the CPU 31 through an I/O interface 42 to a motor driver 47 and a solenoid driver 48. The motor driver 47 drives motors 51 and 52 according to the control data given thereto. The motor 51 drives the secondary sheet conveying rollers 2, the discharge roller 3 and the switchback rollers 4, while the motor 52 drives the secondary feed rollers 5. The motor driver 47 corresponds to the variable speed driving means of the present invention. The solenoid driver 48 drives solenoids 53 and 54 according to the control data given thereto. The solenoids 53 and 54 are connected operatively to the guides 11 and 12, respectively.

Figure 4A:
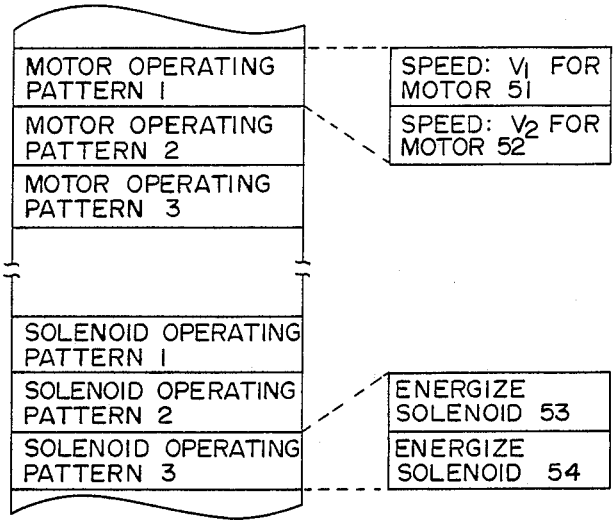
FIG. 4(A) is an illustration of the memory map of a ROM employed in the control unit of the sheet refeeding apparatus of FIG. 2.

A memory map containing a plurality of motor operating patterns and a plurality of solenoid operating patterns as shown in FIG. 4(A) is stored in a ROM 45 connected to the CPU 41. Each motor operating pattern defines the respective rotating speeds $V_1$ and $V_2$ of the motors 51 and 52. Each solenoid operating pattern defines the respective ON/OFF timings of the solenoids 53 and 54. The ROM storing the contents of the memory map corresponds to the memory means of the present invention.

Figure 4B:
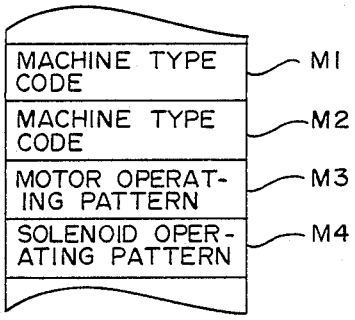
FIG. 4(B) is a memory map of a RAM employed in the control unit of the sheet refeeding apparatus of FIG. 2.

FIG. 4(B) shows the memory area of a RAM 46 connected to the CPU 41. A machine type code and a mode code transmitted from the CPU 31 to the CPU 41 are stored in areas Ml and M2, respectively. The CPU 41 reads, from the ROM 45, a motor operating pattern and a solenoid operating pattern corresponding to a machine type code and a mode code given thereto, and then stores the motor operating pattern and the solenoid operating pattern in the memory areas M3 and M4 of the RAM 46.

Figure 5:
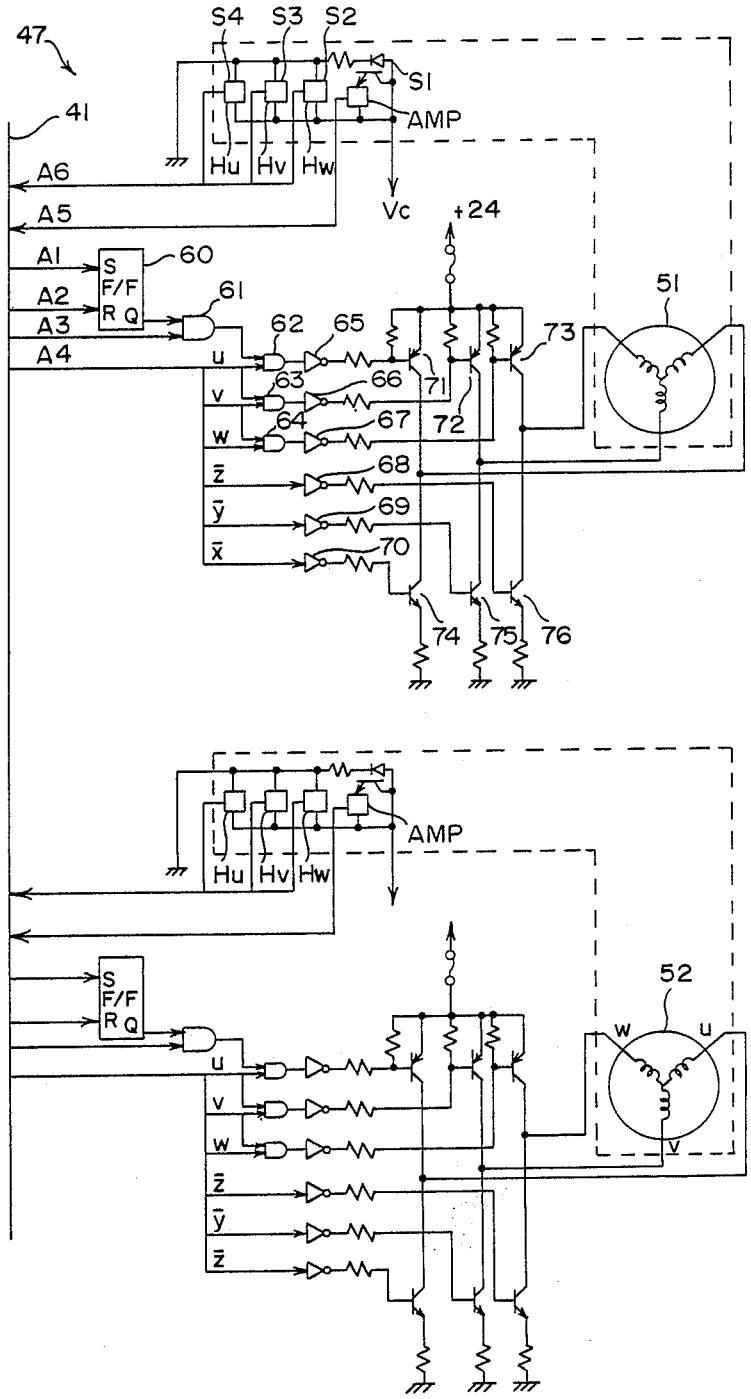
FIG. 5 is a circuit diagram of variable speed driving means incorporated into the sheet refeeding apparatus of FIG. 2.

FIG. 5 is a circuit diagram of the motor driver 47, namely, the variable speed driving means, of the control unit of the sheet refeeding apparatus. The motor driver 47 includes a pair of identical circuits respectively for the motors 51 and 52. The motors 51 and 52 are three-phase brushless DC motors. Each circuit has a motor control circuit including a sensor S1 attached to a rotary encoder RE and sensors S2, S3 and S4 respectively for detecting the conditions of the phase U, the phase V and the phase W. An output signal A5 of the sensor S1 and an output signal A6 of the sensors S2, S3 and S4 are given to the CPU 41. Signals Al and A2 provided by the CPU 41 are applied to the set terminal S and reset terminal R of a flip-flop 60, respectively. The signals Al and A2 determine a set time and a reset time for the flip-flop 60 for the ON-OFF control of current for driving the corresponding motor.

A signal A3 which makes the Q-output of the flip-flop 60 effective or ineffective is applied to a gate 61. A signal A4 is a code for deciding current supply timings for the phase U, the phase V and the phase W. The signal A4 is applied to gates 62 to 64 and gates 68 to 70. Transistors 71 to 76 constitute a motor driving circuit and are controlled for ON-OFF operation by the outputs of the gates 65 to 70. While the transistors 71, 74, 72 and 75 are closed, current is supplied to the phase U and the phase V. While the transistors 72, 75, 73 and 76 are closed, current is supplied to the phase V and the phase W. The transistors are closed or opened sequentially according to the code decided by the signal A4 to form a rotating magnetic field by supplying current sequentially to the phase U, the phase V and the phase W in that order.

When the signal A3 is "H", the gate 61 makes the Q-output of the flip-flop 60 effective. Then, the CPU 41 detects the phase of the rotor of the motor 51 from the outputs of the sensors S2, S3 and S4. Then, the CPU 41 operates the results of detection to provide a combination of conditions of energization of the phases U, V and W. The CPU 41 provides a signal A4 representing a code obtained through the operation. When the CPU 41 provides a signal Al of "H", the flip-flop 60 is set. When the CPU 41 provides a signal A2 of "H", the flip-flop 60 is reset. While the flip-flop 60 is set, the respective current conditions of the transistors 71 to 76 according to the signal A4 are maintained. While the flip-flop 60 is reset, the transistors 71 to 76 are opened. Thus, the rotating speed of the rotor of the motor 51 is regulated by controlling the timing of setting the level of the signal Al for "H" and the timing of setting the level of the signal A2 for "H". The rotating speed of the rotor of the motor 52 is regulated in the same manner. The motor driver 47 shown in FIG. 5 corresponds to the variable speed driving means of the present invention.

Figure 1A:
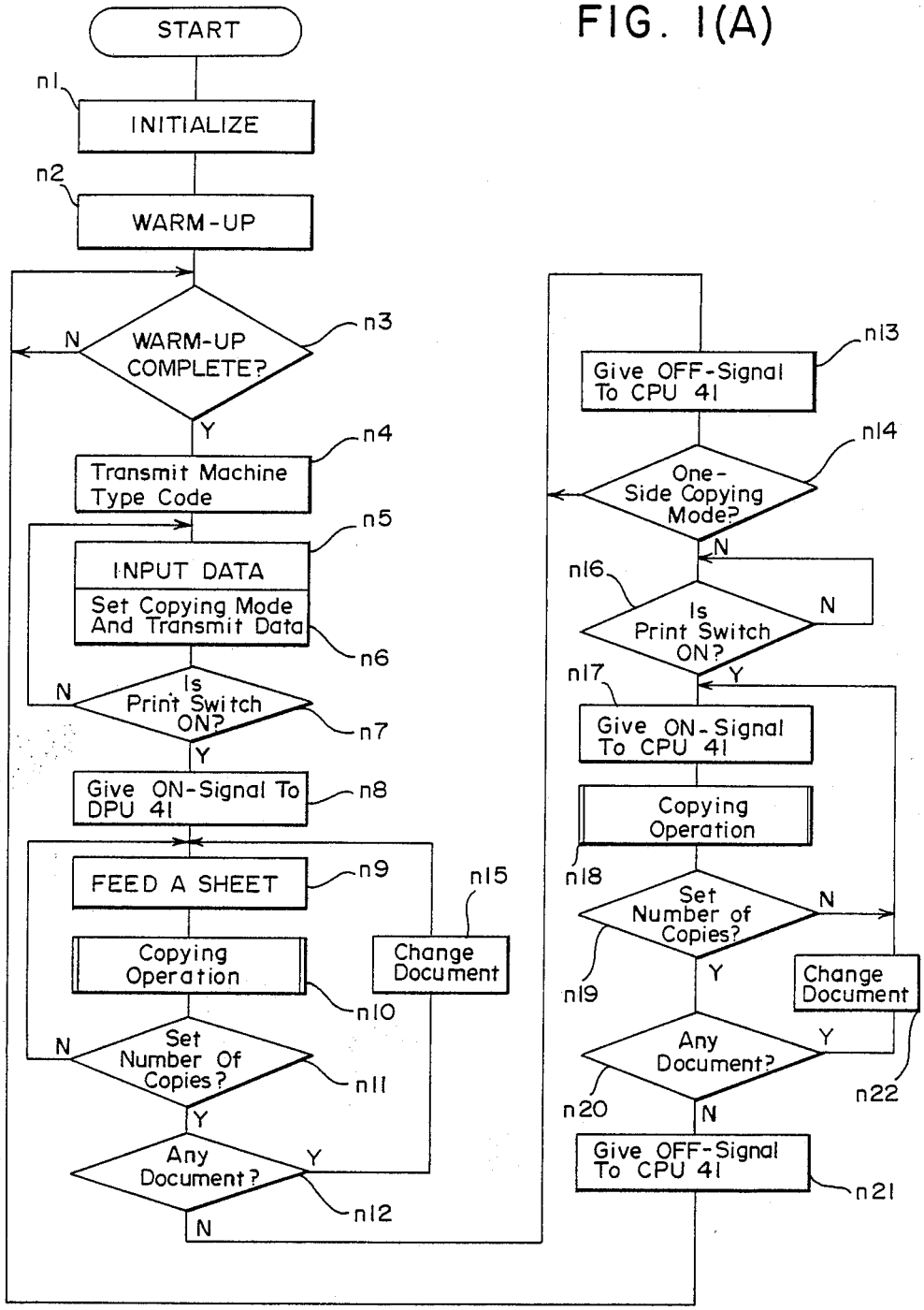
FIGS. 1(A) and 1(B) are flow charts of assistance in explaining a manner of operation of a copying machine equipped with a sheet refeeding apparatus, in a preferred embodiment, according to the present invention.
Figure 1B:
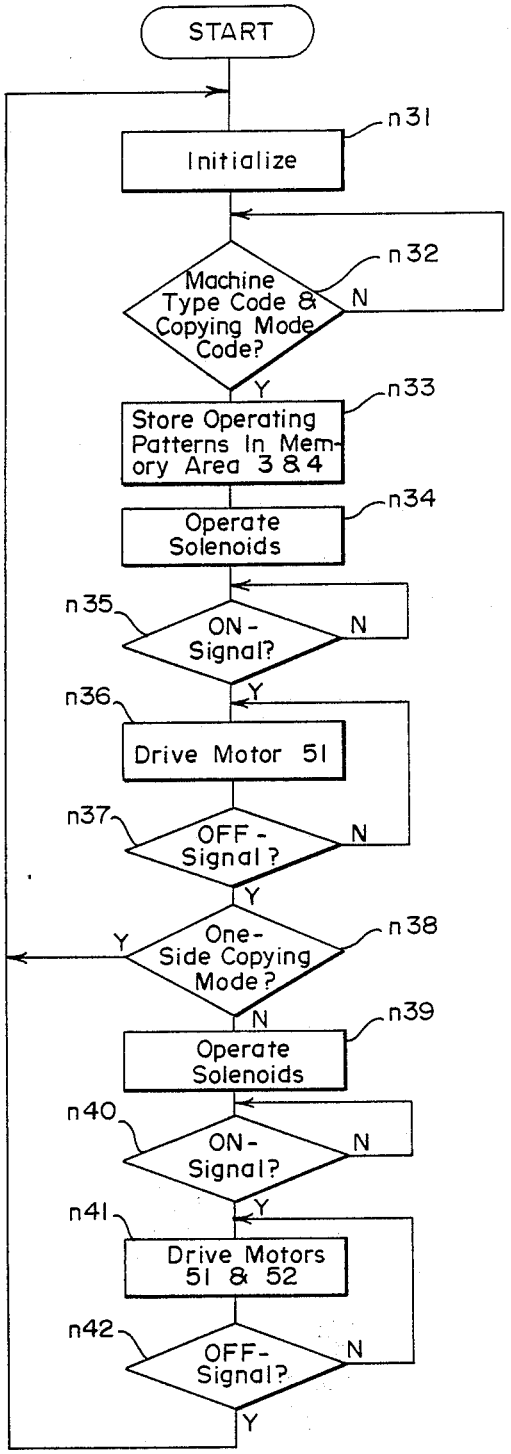

FIG. 1(A) is a flow chart showing steps of operation of the copying machine, while FIG. 1(B) is a flow chart showing steps of operation of the sheet refeeding apparatus.

Upon the connection of the main copying unit 1 to a power source, the control unit including the RAM 36 is initialized at step n1 and a warm-up operation is started at step n2. Upon completion of the warm-up operation (step n3), the CPU 31 gives a machine type code stored in the ROM 35 to the CPU 41 of the sheet refeeding apparatus at step n4. Then, the keys of the control panel 24 are operated at step n5 to give data including sheet size, a desired number of copies and a copying magnification designating copying conditions, and a copying mode is selected. The CPU 31 transmits the selected copying mode to the CPU 41 at step n6. Then, the CPU stores the input data designating copying conditions in memory areas of the RAM 36.

When the print switch 25 is closed, an ON-signal is given to the CPU 41, and the sheet feed section 8 feeds a sheet to the copying section 21 to implement the copying operation (steps n8, n9, and n10). A loop of steps n11-n9-n10-n11 is repeated every completion of a copying cycle to decide whether or not a set number of copies have been produced. After a set number of copies of one document have been produced, a decision is made, if there are any more document to be copied. When there are more documents or documents to be copied, the document is changed, and then a loop of steps n12-n15-n9-n10-n11-n12 is repeated to copy the next document.

After all the documents have been copied, an OFF-signal is given to the CPU 41 at step n13, and then, the CPU 41 checks the set copying mode at step n14. When the set copying mode is a one-side copying mode, the copying operation is ended and the routine returns to step n3. When the set copying mode is a two-side copying mode or a composite copying mode, the print switch 25 is closed at step n16 to continue the copying operation.

When the print switch 25 is closed, an ON-signal is given to the CPU 41 at step n17 and the copying cycle is repeated successively for each document by a number corresponding to the set number of copies (steps n17 to n20, n22). Upon the completion of the set number of copying cycles for each of the set documents, an OFF-signal is given to the CPU 41, and then the copying machine is restored to the waiting condition (steps n20-n21-n3).

Referring to FIG. 1(B), upon the connection of the sheet refeeding apparatus 20 to a power source, the control unit including the RAM 46 is initialized at step n31, and then a decision is made at step n32 as to whether or not the CPU 41 has received a machine type code and a copying mode code from the CPU 31. When the decision at step n32 is YES, the machine type code and the copying mode code are stored in memory areas M1 and M2. Then, the CPU 41 reads a motor operating pattern and a solenoid operating pattern corresponding to the machine type code and the copying mode code from the ROM 45, and then stores the motor operating pattern and the solenoid operating pattern in memory areas M3 and M4, respectively, of the RAM 46 at step n33. The step n33 corresponds to the selecting means of the present invention. Then, the solenoids 53 and 54 are controlled according to the solenoid operating pattern stored in the memory area M4 to position the guides 11 and 12 properly. The sheet refeeding apparatus is kept in a waiting condition until the CPU 31 gives an ON-signal to the CPU 41 (steps n34 and n35).

After an ON-signal has been given to the CPU 41 from the CPU 31, the motor 51 is driven until the CPU 31 gives an OFF-signal to the CPU 41 (steps n35 to n37). The CPU 41 provides the signals Al and A2 at a timing appropriate for driving the motor 51 at a rotating speed $V_1$ specified by the motor operating pattern. Consequently, the secondary sheet conveying mechanism of the sheet refeeding apparatus is driven by the motor 51 at the same speed as that of the sheet conveying mechanism of the main copying unit 1. Upon the reception of an OFF signal from the CPU 31, the CPU 41 checks the set copying mode. When the one-side copying mode is set, the sheet refeeding apparatus is restored to the initial state (steps n37-n38-n31).

When the set copying mode is the composite copying mode, the solenoids 53 and 54 are controlled according to the solenoid operating pattern, so that the guides 11 and 12 are shifted accordingly (steps n38-n39-n40), in which the guide 11 is shifted so as to open a path leading to the discharge roller 3. After an ON-signal is given from the CPU 31 to the CPU 41, the motors 51 and 52 are driven until an OFF-signal is given to the CPU 41. To drive the motors 51 and 52 properly, the CPU 41 gives the signals Al and A2 to the flip-flop 60 at a timing appropriate for making the motors 51 and 52 operate at rotating speeds V: and Vz, respectively specified in the motor operating pattern, so that the secondary sheet conveying mechanism of the sheet refeeding apparatus is driven by the motors 51 and 52 at the same sheet conveying speed as that of the sheet conveying mechanism of the main copying unit 1. Upon the reception of an OFF signal from the CPU 31, the CPU 41 restores the sheet refeeding apparatus to the initial state (steps n42-n31).

Thus a motor operating pattern and a solenoid operating pattern are selected according to a machine type code given from the CPU 31 of the control unit of the main copying unit 1 to the CPU 41 of the control unit of the sheet refeeding apparatus. Particularly, the CPU 41 gives the signals Al and A2 to the motor control circuit so that the motors 51 and 52 are operated at a rotating speed V: and at a rotating speed $V_2$, respectively, specified in the motor operating pattern. The machine type code and the copying mode code are given from the CPU 31 to the CPU 41 at the start of the copying operation, and are cleared every completion of the copying operation. Therefore, a solenoid operating pattern corresponding to a new copying mode is selected when the new copying mode is selected for the next copying operation. An appropriate motor operating pattern corresponding to the machine type of the main copying unit 1 with which the sheet refeeding apparatus is combined is selected according to a machine type code given from the control unit of the copying machine to the control unit of the sheet refeeding apparatus 20. Accordingly, the sheet conveying speed of the sheet refeeding apparatus 20 coincides always with the sheet conveying speed of the copying machine regardless of the type of the copying machine. Although the operating pattern is selected according to the machine type code provided by the control unit of the main copying unit in this embodiment, the operating pattern may be selected by means of a DIP switch provided on the sheet refeeding apparatus or these operating pattern selecting methods may be employed in combination.

While only certain embodiment of the present invention has been described, it will be apparent to those skilled in the art that various changes and modifications may be made therein without departing from the spirit and scope of the present invention as claimed.

What is claimed is:

1. A sheet refeeding apparatus for use in combination with an image forming system including an image forming device having sheet conveying means forming a sheet conveying path between the sheet feed section and the sheet discharge section, said sheet refeeding apparatus comprising:

secondary sheet conveying means;

variable speed driving means for regulating the operating speed of said secondary sheet conveying means;

control means, responsive to said image forming system, for controlling an operating mode and said variable speed driving means;

memory means storing a plurality of control data for controlling said variable speed driving means; and selecting means for selecting control data for controlling said variable speed driving means so that said secondary sheet conveying means operates synchronously with said sheet conveying means of the image forming device from among those control data stored in said memory means.

2. A sheet refeeding apparatus as recited in claim 1, wherein said selecting means selects control data for controlling said variable speed driving means so that said secondary sheet conveying means operates synchronously with said sheet conveying means from among those control data stored in said memory means, and the operating speed of said second conveying means is regulated by said variable speed driving means which is controlled by the control data selected on the basis of said selecting means.

3. A sheet refeeding apparatus as recited in claim 1, wherein said selecting means selects control data for regulating the operating speed of said secondary sheet conveying means at an appropriate operating speed when the image forming system with which the sheet refeeding apparatus is combined is changed for another one.

4. A sheet refeeding apparatus as recited in claim 1, wherein said memory means stores a plurality of data of the operating speed and operating timing of the sheet conveying means of the image forming system.

5. A sheet refeeding apparatus for use in combination with an image forming system having a sheet conveying means forming a sheet conveying path between the sheet feed section and the sheet discharge section, and a secondary sheet conveying means including a secondary sheet conveying path extending between the sheet discharge section and sheet feed section of the image forming system, said sheet refeeding apparatus comprising the operating variable speed driving means for regulating speed of said secondary sheet conveying means;

memory means storing a plurality of control data for controlling said variable speed driving means;

selecting means for selecting control data, said control data corresponding to a plurality of speeds of said variable speed driving means; and control means, responsive to said selecting means, for controlling said secondary sheet conveying means so that said secondary sheet conveying means operates synchronously with said sheet conveying means of the image forming device from among those control data stored in said memory means.

6. An image forming system comprising:

an image forming device having sheet conveying means forming a sheet conveying path between the sheet feed section and the sheet discharge section; and a sheet refeeding apparatus, said sheet refeeding apparatus including a secondary sheet conveying means forming a secondary sheet conveying path between the sheet discharge section and sheet feed section of the image forming device, detection means for detecting a type of said image forming system utilized with said sheet refeeding apparatus, variable speed driving means for regulating the operating speed of said secondary conveying means, memory means storing a plurality of control data for controlling said variable speed driving means, selecting means for selecting control data for controlling said variable speed driving means, and a control unit for controlling the operating mode and operating speed of said secondary sheet conveying means according to said detection means, variable speed driving means, memory means and selecting means, whereby said secondary sheet conveying means operates synchronously with said sheet conveying means of said image forming device.

7. An image forming system as recited in claim 6, wherein said selecting means selects control data for controlling said variable speed driving means so that said secondary sheet conveying means operates synchronously with said sheet conveying means form among those control data in said memory means, and the operating speed of said secondary sheet conveying means is regulated by said variable speed driving means which is controlled on the basis of the control data selected by said selecting means.

8. An image forming system as recited in claim 6, wherein said selecting means selects control data for regulating the operating speed of said secondary sheet conveying means at an appropriate operating speed when the image forming system with which the sheet refeeding apparatus is combined is changed for another.

9. An image forming system as recited in claim 6, wherein said memory means stores a plurality including data of the operating speed and operating timing of the sheet conveying means of the image forming system.

* * * * *